US005141628A

United States Patent [19]

Martin et al.

[11] Patent Number: 5,141,628

[45] Date of Patent: Aug. 25, 1992

[54] METHOD OF CLEANING AND REGENERATING USED OILS

[75] Inventors: Erich-Klaus Martin, Uelzen; Adekunle Onabajo, Clausthal-Zellerfeld, both of Fed. Rep. of Germany

[73] Assignee: RWE-Entsorgung Aktiengesellschaft, Essen, Fed. Rep. of Germany

[21] Appl. No.: 466,262

[22] PCT Filed: Aug. 18, 1988

[86] PCT No.: PCT/DE88/00501

§ 371 Date: Feb. 20, 1990

§ 102(e) Date: Feb. 20, 1990

[87] PCT Pub. No.: WO89/01508

PCT Pub. Date: Feb. 23, 1989

[30] Foreign Application Priority Data

Aug. 19, 1987 [DE] Fed. Rep. of Germany ..... 3727560

[51] Int. Cl.[5] ..... C10G 29/20; C10G 29/22

[52] U.S. Cl. ..... 208/184; 208/179; 208/181; 208/186; 208/187; 208/262.5; 208/180

[58] Field of Search ..... 208/181, 183, 262.5, 208/184, 187, 186

[56] References Cited

U.S. PATENT DOCUMENTS

| | | | |
|---|---|---|---|
| 1,703,647 | 2/1929 | Brunt | 208/181 |
| 4,021,333 | 5/1977 | Habiby et al. | 208/181 |
| 4,154,670 | 5/1979 | Frosbery | 208/181 |
| 4,169,044 | 9/1979 | Crowley | 208/181 |
| 4,269,698 | 5/1981 | Kreger | 208/181 |
| 4,351,718 | 9/1982 | Brunelle | 208/262 |
| 4,410,422 | 10/1983 | Brunelle | 208/262.5 |
| 4,417,977 | 11/1983 | Pytlewski et al. | 208/262.5 |
| 4,431,524 | 2/1984 | Norman | 208/183 |
| 4,524,070 | 2/1988 | Peterson | 208/262.5 |
| 4,532,028 | 7/1985 | Neilis | 208/262.5 |

FOREIGN PATENT DOCUMENTS 0118858 3/1984 European Pat. Off. .

*Primary Examiner*—Helane Myers
*Attorney, Agent, or Firm*—Thomas H. Whaley

[57] ABSTRACT

Used oils, especially used lube oils, after rough filtering are mixed with an aqueous solution of water glass and an aqueous solution of polyalkylene glycol while stirring at elevated temperature, the obtained mixture is allowed to settle, the settlings are separated, and water and light ends are removed from the oil phase by distillation. The thus obtained dry oil phase may be subjected to adsorptive filtering either direct or through a per se known treatment with dispersed sodium and may finally be fractionated by distillation.

15 Claims, No Drawings

METHOD OF CLEANING AND REGENERATING USED OILS

The invention is directed to a method of cleaning and reclaiming used oils, especially used engine and lube oils, by filtering, heat treatment and stripping of the light ends comprising solvents and water.

Used oils are especially mineral oils. The service value of motor oils and especially lube oils is considerably affected by oxidation products, contaminants and other impurities which accumulate during use. Such products can no longer fully satisfy the requirements and must be exchanged. They are known as used oils and are collected and reprocessed for reasons of environmental protection, conservation of resources and also under economic aspects. Used oils are predominantly composed of a base stock on the basis of mineral oil or synthetic oil, but they comprise considerable amounts of foreign materials such as water, solvents, motor fuel, asphalt-like materials, acids, resins, ashes and additives such as antioxidants, anticorrosives, wetting agents, dispersants, antifoam agents and viscosity index improvers. The additives may contain halogen, sulphur and nitrogen compounds as well as numerous other and partly toxic components.

Used oils are initially cleaned mechanically by separating undissolved contaminants and impurities by means of sedimentation, filtering or centrifuging. The separation can be considerably accelerated when the used oil is heated to a temperature of 50° to 100° C.

Conventional reclaiming of used oils is effected in a multi-stage process as described in Ullmanns Encyklopä die der technischen Chemie, 4th edition, vol. 20, p. 498. Following the rough removal of water and solid impurities, light ends and residual water are removed by atmospheric distillation at a temperature of about 250° C., whereafter oxidation products and additives are removed by sulphuric acid refining with subsequent calcium neutralization, and the refinery residue is removed by decanting or filtering, respectively. The breakdown into one to two light-viscosity or medium-viscosity distillate and residue fractions occurs by vacuum distillation at a pressure of 80 to 100 mbar, and finally the fractions are fined and stabilized by clay treatment.

According to the PROP process of Phillips Petroleum Co. as described in Hydrocarbon Processing, September 1979, pp. 148 et seq., used oil after pretreatment with an aqueous solution of diammonium phosphate is subjected to refining hydrogenation over nickel-molybdenum catalysts. Although it is said that in this process polychlorinated biphenyls are also decomposed at least partially, chlorinated solvents and wash solvents, metal machining oils and other machining oils having no clearly identified composition, as well as insulating and transformer oils should not be contained in the feedstock for this reclaiming process. Suitable feedstock for this process therefore are substantially used motor oils.

According to the KTI process of Kinetics Technology International, the used oil is freed by sedimentation from water and contaminants and is then freed by atmospheric distillation from residual water and light ends. Thereupon the gas oil fraction is removed in a separate step. In the subsequent vacuum distillation, the lube oil components are fractionated, condensed and any dirt, additives and part of the oxidation products are extracted as bottoms. The distillates are hydrofined and stripped. Since acid refining is not provided also in this process, additives or foreign components must be either removable by distillation or capable of conversion by hydrogenation. Ingredients must not affect the activity of the hydrogenation catalyst so that cutting oils, for instance, which contain halogenated hydrocarbons likewise cannot be processed by this method, see Ullmanns Encyklopäie der technischen Chemie, 4the edition, vol. 20, p. 500.

In the Recyclon processes, the oxidation products and additives are likewise not removed by means of sulphuric acid but are removed by treatment with dispersed sodium, whereby they either polymerize or are transformed to sodium salts having such a high boiling point that the oil can be distilled. Distillation is performed in two steps, the second step being short-path thin-film evaporation for separating the reaction products.

Thus, the known methods and processes require great technical efforts and are furthermore insufficient for the used oil mixture which is combined for reclaiming at the collecting points and which comprises random components.

The present invention is based on the object of developing a universally useful method which permits the removal of harmful substances and other undesirable components from used lube oils and other used oils at higher product yields and higher product quality and at the same time with less effort and in particular with less dumping of waste than has hitherto been possible in the prior art. In particular, the method is suited to include special treatments such as hydrogenation or treatment with sodium, and it is intended to result in simplified processes and consequent cutting-down of costs, for instance by avoiding catalyst poisoning when a hydrogenation step is used.

In accordance with the present invention the above-specified object is solved in that used oils after rough filtering either (1) are heated to a temperature of 50° to 100° C. in a closed stirrer and with thorough stirring there are added thereto, respectively based on the used oil, 0.5 to 2.5 wt. % of an aqueous solution of alkali water-glass having a water content of 30 to 70 wt. %, based on the solution, and 0.25 to 2.5 wt. % of an aqueous solution of a polyalkylene glycol having the formula $$RO-(\underset{\underset{R_1}{|}}{CH}-CH_2-O)_n-R_2 \qquad \text{I}$$

wherein $R_2$=n-alkyl with 8–20 carbon atoms, $R_1$=hydrogen, alkyl with 1 to 3 carbon atoms, n=20 to 125 with an average molecular weight of 1,000 to 10,000 and a water content of 80 to 97.5 wt. %, based on the solution, or are heated to a temperature of 60° to 80° C. in a closed stirrer and with thorough stirring there are added thereto, respectively based on the used oil, 0.5 to 2.5 wt. % of an aqueous solution of alkali water-glass having a water content of 30 to 70 wt. %, based on the solution, and 0.25 to 2.5 wt. % of an aqueous solution of a polyalkylene glycol having the formula $$R_2O-(\underset{\underset{CH_3}{|}}{CH}-CH_2-O)_nR_2 \qquad \text{II}$$

wherein $R_2$=n-alkyl with 10 to 14 carbon atoms, n=21 to 30 and an average molecular weight of 2,000 to 5,000 with a water content of 80 to 97.5 wt. %, based on the solution, (2) the obtained mixture is allowed to settle in a decanter at a temperature of 70° to 90° C., the settlings are separated and (3) the light ends comprising water and solvent are separated from the oil phase at a temperature of 100° to 140° C. and a pressure of 20 to 100 Torr.

In step (2) dehydration is especially carried out. The feedstock will bind the water in the form of residue which is then removed by separation in a known way. 50 to 80% of the free water existing in the used oil are removed in this way. Removal of the residual water and of the light ends is then effected by distillation in step (3). The used oil treatment according to the method steps (1) to (3) is carried out at a temperature range of from 50° to 140° C., the lowest possible temperatures of this range being preferred. In step (3), PCB enrichment in the light ends and in water is excluded because the boiling point of polychlorinated biphenyl and terphenyl is above the stripping temperature. Removal of PCB is therefore not carried out in step (3), whereby it is ensured that light ends and water obtained by this method are not PCB-loaded. This is of great significance to an environmentally harmless process of reclaiming used oil.

Method step (3) may also be performed prior to step (2) by initially separating the light ends from the obtained mixture whereupon settling takes place in a decanter and finally the settlings are removed.

Preferably, in method step (1) the solutions of alkali water-glass and/or the solutions of polyalkylene glycol are preheated, especially to a temperature of 30° to 60° C., preferably to about 50° C.

In accordance with a further embodiment of the method of the present invention, the oil phase which has been pretreated in the steps (1) to 3) is further treated by (4) adding to the oil phase at a temperature of 30° to 120° C., 3 to 8 parts by weight of n-alkenes having 6 to 10 carbon atoms per 1 part by weight of the pretreated oil phase, stirring well for some time while maintaining the temperature, allowing the obtained mixture to settle in a decanter at room temperature, removing the settlings, treating the oil phase in an adsorber having a filter element, said filter element comprising clays or compacted alumina, and removing the light ends (n-alkanes) from the obtained oil filtrate at a temperature of 50° to 80° C. and a pressure of 20 to 100 Torr.

A further improvement of the method according to the invention, especially for treating used oils containing polychlorinated biphenyl and terphenyl, consists in that the oil phase pretreated by the steps (1) to (3) is further treated by (6) heating the pretreated used oil phase to a temperature of 70° to 120° C. in a closed stirrer and adding thereto 3 to 8 parts by weight of n-alkenes having 6 to 10 carbon atoms per 1 part by weight of pretreated used oil phase, adding thereto with thorough stirring and respectively based on the pretreated used oil phase, 0.1 to 0.5 wt. % of an aqueous solution of alkali water-glass at a pH of ≧9 and 0.1 to 0.5 wt. %, of polyalkylene glycol having the formula $$HO-(\underset{\underset{R_1}{|}}{CH}-CH_2-O)_n-H, \qquad \text{III}$$

in which $R_{\beta 1}$=hydrogen or methyl, n=9 to 22, with a hydroxyl number of 100 to 300 mg KOH/g according to DIN 53240 and an average molecular weight of 380 to 1050, while maintaining the temperature for a time of from 15 to 120 minutes, especially 30 to 100 minutes and preferably about 50 to 60 minutes, stirring thoroughly, adding 0.1 to 0.25 wt. % of anhydrous alkali metasilicate, based on the used oil phase, stirring again for 5 to 15 minutes, (7) causing the obtained mixture to settle in a decanter at room temperature, removing the settlings, (8) treating the oil phase at a temperature of 30° to 60° C. in an adsorber, preferably a percolation adsorber with a filter element, said filter element comprising clays or compacted alumina, and (9) removing from the oil filtrate the light ends (n-alkanes) at a temperature of 50° to 80° C. and a pressure of 20 to 100 Torr.

It is preferred to use in step (6) 0.1 to 0.5 wt. %, based on the used oil phase, or polyethylene glycol having the general formula $$HO-(CH_2-CH_2-O)_n-H \qquad \text{IV}$$

wherein N=9 to 22, with a hydroxyl number of 100 to 300 mg KOH/g especially 170 to 210 mg KOH/g according to DIN 53240, and an average molecular weight of 380 to 1050, especially 480 to 650, and 3 to 8 parts by weight of n-alkenes having 6 to 10 carbon atoms per 1 part by weight of the pretreated oil phase.

In a further improvement of the method according to the invention, a hydrogenation step may be interposed between steps (3) and (4), in which the pretreated oil phase is hydrogenated in the presence of a hydrogenation catalyst especially at a temperature of 200° to 400° C. and a pressure of 10 to 200 bar, preferably at a temperature of 300° to 380° C. and a pressure of 40 to 60 bar. Normally, however, this incorporation of known hydrogenation processes will be economically feasible only when the method according to the invention is to be used in an already existing hydrogenation plant.

The filter element of method steps (4) to (8) is regenerated as required by washing off adsorbed material with a solvent. It is preferred to use a ketone solvent for this purpose, said solvent especially comprising one or several solvents each having a boiling point of from 50° up to 80° C. and being in particular acetone or methyl ethyl ketone.

In accordance with a further embodiment of the method of the present invention, the treated oil phase is finally subjected to vacuum distillation at a temperature of 200° to 300° C. and a pressure of 1 to 50 Torr.

For the treatment of used oils which contain polychlorinated biphenyls and terphenyls it is provided in accordance with a further embodiment of the method of the present invention that in a manner known per se a treatment of the dry oil phase (having a water content of <0.1 wt. %) with dispersed sodium is performed subsequent to step (3). The steps (1) to (3) are capable of supplying a constant stream of anhydrous oil which is the most important prerequisite for the use of sodium. Since in this anhydrous oil stream the oxidation products and the non-PCB chlorine compounds have been largely removed by the pretreatment, the sodium process is quite economic.

The sodium required for the used oil treatment is added to the pretreated used oil as a dispersion, especially comprising sodium particles of 5 to 10 μm, in a base oil having a composition similar to that of motor oils. To this end, sodium in an oil which is preferably a rerefined product is melted open and dispersed in a dispersant so that particle sizes of <20 μm are obtained. A dispersion of 33 wt. % of sodium is especially suitable for the treatment of the pretreated dry oil stream. The amount of dispersant added is adapted to the content of inorganically bonded chlorine. The treatment temperature and time depend on the quality of the dry oil. Normally, reliable removal of PCB is achieved in a temperature range of 20° to 250° C. and especially of 100° to 200° C. and within a time of 1 to 30 minutes.

In the treatment of used oil with sodium, sodium chloride will be formed which is contaminated with metal oxides, metal carbonates and metal sulphates. These oil containing solids are removed, for instance by settling in a separator or decanter. The oil phase, which is now free from PCB's and chlorine, is subjected to the treatment according to step (4) and subsequently distilled.

The method according to the present invention is a mild method which is harmless to the environment. At the same time a low-cost and simple process and apparatus technique is ensured. Several physical and chemical processes proceed in a parallel in the various steps of the pretreatment. Removal of all harmful materials as well as the treatment proceed under mild process conditions. In this respect the "adsorptive filtering" has special significance for the purification of the material to be reclaimed. The steps of the method according to the present invention are the following:

flocculation and conversion of dispersed impurities adsorption and sedimentation of the flocculated and converted impurities adsorptive filtering for selectively separating dissolved and undissolved dispersed impurities such as degradation products, oxidation products, additives distillation or stripping of the materials outside of the boiling range of the lube oils.

The obtained base oil is distinguished by a more favourable and higher viscosity index than that of virgin oil. All ash-forming additives—which otherwise cause the formation of sludge—are removed, i.e. the ash content is practically 0 wt. %. The viscosity index improvers are largely retained and amount to approximately at least one-third of the corresponding additives of the fresh additive package.

Impurities in the used oil form stable dispersions due to detergents present therein. Additives present the physical separation of the impurities by gravity and/or centrifugal force. In accordance with the present invention, in step (1) the flocculation and adsorption agents, i.e. alkakli water-glass and polyalkylene glycol of the specified formula, destabillize the dispersion. Thereby the density differences between oil phase and impurity phase become effective. In parallel to this process, there occurs a chemical conversion of the chlorine compounds and the formation of NaCl and of non-chlorinated compounds. The oxidation products are neutralized, and the converted and neutralized products are adsorbed.

In step (2), impurities and the flocculation and adsorption agents are removed. Due to the destabilization effected in step (1) and the density differences which became effective in step (1), the flocculated dispersed impurities are separated by the action of gravity or minimum centrifugal forces by means of decanters or separators.

In step (3) the light ends, i.e. polar and non-polar solvents, as well as water are removed.

The solvent and adsorbent addition in step (6) serves the purpose of further flocculating dispersed impurities, wherein these additives cause the removal of polychlorinated biphenyls and terphenyls and the addition of solvent promotes the later step of adsorptive filtering. If there are not polychlorinated biphenyls and terphenyls, one may proceed direct to the adsorptive filtering stage by adding the n-alkenes and without any further addition of adsorbent —see method step (4).

Step (6) including the addition of solvent and adsorbent is followed by step (7), which corresponds largely to step (2).

In step (8) or step (4), respectively, adsorptive filtering is carried out. In this step the remaining dissolved and undissolved impurities as well as undesirable residual additives are controlledly bonded to the adsorbents. The lube oil components (hydrocarbons) pass the adsorbents. This adsorptive filtering is a multi-parameter separation method which is characterized in that two chemically different materials or two chemically different groups of materials are separated from one another due to their different adsorptive capacity while a predetermined solvent and an adsorbent act on the mixture. As compared to usual filtering, adsorptive filtering differs insofar as there is only a single phase during separation, whereas filtering requires two phases, usually solid/liquid. As compared with normal adsorption, adsorptive filtering is distinguished by its selectively which is achieved by the selective solvent and a chosen adsorbent, in the present case these being clays or compacted alumina; see "Filtrierende Adsorption", W. Fuchs, F. Glaser and E. Bendel, Chemie-Ingenieurtechnik 1959, pp. 677 to 679.

Adsorbed material, viz. 5 to 10 wt. % of dispersed dissolved oxidation products and residual additives, are desorbed with suitable solvents, i.e. solvents having a boiling point of up to 80° C., especially acetone or methyl ethyl ketone. The adsorbent is dried at a temperature of about 60° to about 120° C., preferably about 100° C., in an inert gas atmosphere, preferably nitrogen, and is then caused to adopt the temperature required for step (8). Thus, the adsorbent is again ready for use and may be used continually in this way.

The lube oil ingredients (about 1.5 wt. %) contained in the adsorbent are dissolved out prior to the regeneration of adsorbent (with acetone or methyl ethyl ketone) by solvent washing, especially with n-heptane, and are passed to step (6) to (9). This step serves to increase the yield of reclaimed material.

The residual additives and oxidation products obtained after solvent evaporation are used as additives for example in asphalt processing. PCB's, chlorinated dioxins, furans and aliphatics having a chlorine content of >5% can be decomposed in this way to below the detection limit. The recovered solvent is reused for solvent washing.

In step (5) or step (9) the solvent is separated from the reclaimed material and is returned to step (4) or (6), respectively.

When the finally obtained oil phase is a mixture of the oil fractions having different flash points and viscosities, the fractions must be separated under vacuum and at temperatures in excess of 200° C. The bottoms constitute the base oil.

The method comprising the steps (1) to (3) can be used for decentralized used oil treatment insofar as the collected used oils are combined at regional collecting points and are part-treated in decentralized small-scale plants in accordance with the method comprising the steps (1) to (3). The thus treated used oil can then be subjected to the methods according to one or several of the subclaims in a central large-scale plant, especially for the removal of chlorine compounds and prechlorinated biphenyls and terphenyls.

It is preferred to use the following feed materials:

1. as alkali water-glass sodium water-glass 50/51 in steps (1) and step (6), alkaline, filtered

| analysis: | |
|---|---|
| $H_2O$ | 54.4–55.4% |
| $SiO_2$ | 30–30.5% |
| $Na_2O$ | 14.6–15.1% |
| $\eta$ mPas/20° C. | 400–600 |
| $\rho$ kg/m$^3$, 20° C. | 1530. |

Sodium water-glass 58/60 in step (1), filtered:

| analysis: | |
|---|---|
| $H_2O$ | 45.5% |
| $SiO_2$ | 36.5% |
| $Na_2O$ | 18.0% |
| $\eta$ mPas/20° C. | more than 10,000 |
| $\rho$ kg/m$^3$, 20° C. | 1710 |

2. as alkali metasilicate in step (6), anhydrous:

| analysis: | |
|---|---|
| $SiO_2$ | 48 ± 1.0% |
| $Na_2O$ | 51 ± 1.0% |

3. as polyalkylene glycol (non-ionogenic) in step (1):

polypropylene glycol having $C_{12}H_{25}$ terminal groups, average molecular weight 2,000 to 10,000 solutions active at a concentration range of 2.5 to 20 wt. %.

4. as polyalkylene glycol in step (6):

polyethylene glycol (PEG)

hydroxyl number 100 to 300 mg KOH/g according to DIN 53240, average molecular weight 380 to 1,050.

5. as solvents in steps (4) and (6):

n-alkanes, $C_6$–$C_{10}$, especially n-heptane, commercial product.

6. as adsorbents in steps (4) and (8):

TONSIL CCG 30/60 mesh and TONSIL LFF 80 grain size distribution: wide <0.25 mm to >0.55 mm chemical composition: $SiO_2$, $Al_2O_3$, $Fe_2O_3$, MgO, CaO, $Na_2O$ and $K_2O$.

COMPALOX, compacted alumina grain size 1.5 to 5 mm specific surface 180 to 200 m$^2$/g chemical composition: $Al_2O_3$(92%), $SiO_2$(0.01–0.02%), $Fe_2O_3$(0.01–0.03%), $Na_2O$(0.4–0.6%).

regeneration of adsorbent with acetone, methyl ethyl ketone (commercial).

Used filters: special steel, screen 20 μm to 200 μm; glass fibre filters and nonwoven filters.

The following examples will further explain the invention.

EXAMPLE 1

95 parts of used oil blended from various collecting points were heated after rough filtering to a temperature of 70° C. in a closed stirrer and with thorough stirring there were added thereto, respectively based on the used oil, 2.5 wt. % of an aqueous solution of alkali water-glass 58/60 preheated to 50° C. and having a water content of 54 wt. %, based on the solution, and 2.5 wt. % of an aqueous 20 wt. % solution of polypropylene glycol (average molecular weight 3,000) preheated to 50° C. and having a water content of 80 wt. %, based on the solution. Following the addition of the feed materials, thorough stirring of the mixture was continued for 30 minutes at 80° C. The then obtained mixture was allowed to settle in a decanter at 70° C. at a flow rate of 3,000 ml/h and the oil phase was separated. From the oil phase, the light ends and residual water were separated at a temperature of 130° C. and a pressure of 50 Torr.

EXAMPLE 2

Non-PCB-containing used oil in the form of a dry oil phase pretreated according to example 1 was blended in a closed stirrer with n-heptane at a ratio of oil phase to n-heptane of 1:4 parts by wight and was thoroughly stirred at 40° C. for 30 minutes. The oil solution was then allowed to settle in a decanter at 10°–20° C. at a flow rate of 12,000 ml/h, and then the oil solution was separated from the bottoms.

EXAMPLE 3

To PCB-containing used oil in the form of the oil phase pretreated according to example 1 to which n-heptane had been admixed at a ratio of oil phase to n-heptane of 1:4 parts by weight, there was added with thorough stirring in a closed stirrer at a temperature of 80° C. a mixture comprising 0.25 wt. % of sodium water-glass 50/51 (alkaline) and 0.1 wt. % of polyethylene glycol (average molecular weight 600, OH-number 170 mg KOH/g), each based on the dry oil phase, said mixture having been preheated to 50° C. Thorough stirring of the mixture was continued at 70° C. for about 110 minutes. Thereafter 0.1 wt. % of anhydrous sodium metasilicate was added and stirring continued for another 10 minutes. The oil solution was allowed to settle in a decanter at 10°–20° C. at a flow rate of 12,000 ml/h, and the oil solution was separated from the bottoms.

EXAMPLE 4

The oil solution obtained in examples 2 and 3 was subjected to "adsorptive filtering". The adsorber consisted of a special steel screen (20–40 um) and an adsorbent package comprising clay, Tonsil CCG 30/60. The adsorption of undesired oil ingredients took place at 40° C. Regeneration was performed with n-heptane. The flow rate of regenerate solution was 3,000 ml/h. From the regenerate solution, the n-heptane solvent was recovered by distillation at a temperature of 70° C. and a pressure of 50 Torr.

The obtained regenerate was a mixture of lube oil fractions having different flash points and viscosities. The fractions were broken down under vacuum at a temperature of 250°-300° C. and a pressure of from 1 to 10 Torr. The bottoms product was the base oil.

In the meantime the adsorbent was regenerated by desorption of the adsorbed impurities (oxidation products, undesired residual additives, degradation products etc.) at a temperature of 50° C. with acetone (boiling point 56° C.). The adsorbent was dried under a flow of nitrogen at a temperature of 60° C. and was made reusable.

The obtained acetone solution was subjected to distillation to remove acetone from the waste. The acetone was reused.

EXAMPLE 5

The waste materials from examples 1, 2, 3 and 4 were used as loading materials at a concentration range of 0.5 to 5 wt. % (based on bitumen) for asphalt modification.

Instead of step (4) or step (8) one may also use thin-film evaporation which is known per set. Likewise, following the treatment with dispersed sodium the obtained oil phase may be subjected to thin-film evaporation instead of step (4).

The method in accordance with the present invention is distinguished from prior art methods by numerous advantages:

high economical efficiency
high reliability of operation
mild treating method
decentralized waste disposal possible
partial integration of existing plants and methods
process residues are completely reusable as loading materials/resources for other products or for recycling to preceding stages.

The obtained base oil was distinguished by a better and higher viscosity index than the virgin oil. All ash-forming additives—which otherwise cause sludge formation (especially in the engine)—are removed, i.e. the obtained base oil has an ash content of almost 0.0 wt. %. Finally, the viscosity index improvers are largely retained, hitherto to at least about one-third of the additive content of the fresh additive package.

We claim:

1. A method of cleaning and reclaiming used oils by filtering, thermal treatment and stripping of the light ends comprising solvent and water, which comprises:

(1) heating the used oils to a temperature in the range of 50° to 100° C. and adding thereto with thorough stirring, 0.5 to 2.5 wt. % based on the used oil of an aqueous solution of alkali water-glass having a water content of 30 to 70 wt. %, based on the solution, and 0.25 to 2.5 wt. % of an aqueous solution of a polyalkylene glycol having the formula $$R_2O-(\underset{\underset{R_1}{|}}{CH}-CH-O)_n-R_2$$

wherein $R_2$=n-alkyl with 8–20 carbon atoms, $R_1$=hydrogen, alkyl with 1 to 3 carbon atoms, n=20 to 125 with an average molecular weight of 1,000 to 10,000 and a water content of 80 to 97.5 wt. %, based on the solution, (2) setting the mixture in a decanter at a temperature of 70° to 90° C., and separating the settled material therefrom, (3) separating the light ends comprising water and solvent from the oil phase at a temperature of 100° to 140° C. and a pressure of 20 to 100 Torr and recovering the resulting dry oil phase.

2. The method as claimed in claim 1, wherein the oil phase pretreated in steps (1) to (3) is further treated by adding to the oil phase at a temperature in the range of 30° to 120° C., 3 to 8 parts by weight of n-alkenes with 6 to 10 carbon atoms per 1 part by weight of the pretreated oil phase with thorough stirring, settling the resulting mixture and separating the settled materials therefrom, treating the oil phase in an adsorber with a filter element, said filter element comprising clays or compacted alumina, and removing from the obtained oil filtrate the light ends at a temperature in the range of 50° to 80° C. and a pressure in the range of 20 to 100 Torr.

3. In a method of treating used oils as defined in claim 1 wherein the used oil also contains polychlorinated biphenyls and terphenyls, the additional steps comprising adding to said dry oil phase at a temperature in the range of 70° to 120° C. 3 to 8 parts by weight of n-alkanes having 6 to 10 carbon atoms per 1 part by weight of said dry oil phase, and 0.1 to 0.5 wt. % of an aqueous solution of alkali water-glass of pH=9 and 0.1 to 0.5 wt. % of polyalkylene glycol having the general formula $$HO-(\underset{\underset{R_1}{|}}{CH}-CH_2-O)_n-H$$

wherein $R_1$=hydrogen or methyl, n=9 to 22, a hydroxyl number of 100 to 300 mg KOH/g and an average molecular weight of 380 to 1050, while thorough stirring for 15 to 120 minutes while maintaining the temperature and then adding 0.1 to 0.25 wt. % of anhydrous alkali metasilicate, based on the dry oil phase, with continued stirring for 5 to 15 minutes, settling the resulting mixture at room temperature and separating the settled material therefrom, treating the resultant oil phase at a temperature of 30° to 60° C. with adsorbent clays or compacted alumina, and separating the light ends therefrom at a temperature of 50° to 80° C. and a pressure of 20 to 100 Torr.

4. The method of claim 3, wherein the polyethylene glycol has the general formula $$HO-(CH_2-CH_2-O)_n-H$$

wherein n=9 to 22, a hydroxyl number of 100 to 300 mg KOH/g and an average molecular weight of 380 to 1,050.

5. The method of claim 1 characterized in that the treated oil phase is finally subjected to vacuum distillation at a temperature of 200° to 300° C. and a pressure of 1 to 50 Torr.

6. The method of claim 2 characterized in that the pretreated dry oil phase is further treated with dispersed sodium by mixing the oil phase in a closed reaction zone with a sodium/oil dispersion comprising dispersed sodium particles in a base oil, at a temperature of 100° to 250° C. and the resulting oil-containing solids are separated from the resulting treated mixture prior to the addition of alkanes.

7. The method of claim 1 wherein the dry oil phase is subjected to thin-film evaporation.

8. The method of claim 1 wherein the dry oil phase is hydrogenated in the presence of a hydrogenation catalyst at a temperature in the range of 200° to 400° C. and a pressure in the range of 10 to 200 bar.

9. The method of claim 1 wherein the solution of alkali water-glass and the solution of polyalkylene glycol are at a temperature in the range of 30° to 60° C.

10. The method of claim 1 wherein the light ends are separated from the resulting mixture prior to separating solid material therefrom.

11. The method of claim 2 wherein the treated oil phase is subjected to vacuum distillation at a temperature of 200° to 300° C. and a pressure of 1 to 50 Torr.

12. The method of claim 3 wherein the treated oil phase is subjected to vacuum distillation at a temperature of 200° to 300° C. and a pressure of 1 to 50 Torr.

13. A method according to claim 1 wherein the polyalkylene glycol has the formula $$R_2O-(\underset{\underset{CH_3}{|}}{CH}-CH_2-O)_n-R_2$$

wherein $R_2$=n-alkyl with 10 to 14 carbon atoms, and n=21 to 30 with an average molecular weight of 2,000 to 5,000.

14. The method of claim 1 wherein the alkali water glass is an aqueous solution of sodium silicate.

15. The method of claim 1 wherein the dry oil phase is hydrogenated in the presence of a hydrogenation catalyst at a temperature in the range of 300° to 380° C. and a pressure in the range of 40 to 60 bar.

* * * * *

UNITED STATES PATENT AND TRADEMARK OFFICE

CERTIFICATE OF CORRECTION

PATENT NO. : 5,141,628

DATED : August 25, 1992

INVENTOR(S) : Erich-Klaus Martin and Adekunle Onabajo

It is certified that error appears in the above-identified patent and that said Letters Patent is hereby corrected as shown below:

Col. 2, lines 47 to 49, the formula I should be $$--R_2O-(\underset{\underset{R_1}{|}}{C}H-CH_2-O)_n-R_2--.$$

Col. 4, line 6, "$R\beta_1$" should be --$R_1$--.

Claim 1 (col. 9, line 64), "setting" should be --settling--.

Claim 2 (col. 10, line 6), "n-alkenes" should be --n-alkanes--.

Signed and Sealed this

Nineteenth Day of October, 1993

Bruce Lehman

*Attest:*

BRUCE LEHMAN

*Attesting Officer*

*Commissioner of Patents and Trademarks*